US012765593B2

(12) United States Patent
Zhao et al.

(10) Patent No.: US 12,765,593 B2
(45) Date of Patent: Oct. 20, 2026

(54) BATTERY ROD, VAPORIZER, AND ELECTRONIC VAPORIZATION DEVICE

(71) Applicant: SHENZHEN SMOORE TECHNOLOGY LIMITED, Shenzhen (CN)

(72) Inventors: Bosong Zhao, Shenzhen (CN); Wenjie Dong, Shenzhen (CN); Weiming Fang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 830 days.

(21) Appl. No.: 18/188,386

(22) Filed: Mar. 22, 2023

(65) Prior Publication Data

US 2023/0217996 A1 Jul. 13, 2023

Related U.S. Application Data

(63) Continuation of application No. PCT/CN2020/117847, filed on Sep. 25, 2020.

(51) Int. Cl.
*A24F 40/40* (2020.01)
*A24F 40/50* (2020.01)

(52) U.S. Cl.
CPC ..... *A24F 40/40* (2020.01); *A24F 40/50* (2020.01)

(58) Field of Classification Search
CPC ..... A24F 40/50; A24F 40/40; Y02E 60/10
See application file for complete search history.

(56) References Cited

U.S. PATENT DOCUMENTS 9,155,848 B2 10/2015 Emarlou
10,070,662 B2 * 9/2018 Gorilovsky ..... A24B 15/167
(Continued)

FOREIGN PATENT DOCUMENTS

CN 101756352 A 6/2010
CN 103230099 A 8/2013
(Continued)

OTHER PUBLICATIONS

Chinese Patent Office, Office Action in Chinese Patent Application No. 202011024478.X (May 26, 2023).
(Continued)

*Primary Examiner* — Yong Hang Jiang
(74) *Attorney, Agent, or Firm* — Leydig, Voit & Mayer, Ltd.

(57) ABSTRACT

A battery rod includes: a first connecting end and a second connecting end connectable with a vaporizer inserted into the battery rod; and a control chip connected with the first connecting end for sending a first communication signal to the vaporizer inserted into the battery rod and receiving a second communication signal from the vaporizer through the first connecting end so as to realize communication between the battery rod and the vaporizer. The first communication signal includes a first level signal as a logic high level and a second level signal as a logic low level. The second communication signal includes a third level signal as a logic high level and a fourth level signal as a logic low
(Continued)

level. A voltage difference between the first level signal and the second level signal is greater than a voltage difference between the third level signal and the fourth level signal.

13 Claims, 5 Drawing Sheets

(56) References Cited

U.S. PATENT DOCUMENTS

| | | | | |
|---|---|---|---|---|
| 2011/0277764 | A1 | 11/2011 | Terry et al. | |
| 2013/0104916 | A1 | 5/2013 | Bellinger et al. | |
| 2015/0027466 | A1 | 1/2015 | Xiang | |
| 2015/0036250 | A1 | 2/2015 | Xiang | |
| 2017/0000192 | A1 | 1/2017 | Li | |
| 2017/0303595 | A1 | 10/2017 | Bernauer et al. | |
| 2018/0043114 | A1 | 2/2018 | Bowen et al. | |
| 2018/0153219 | A1* | 6/2018 | Verleur | A24F 40/40 |
| 2019/0008208 | A1 | 1/2019 | Cirillo et al. | |
| 2019/0364968 | A1* | 12/2019 | Fu | A24D 1/14 |
| 2020/0029622 | A1* | 1/2020 | Fei | F16J 15/02 |
| 2020/0278707 | A1 | 9/2020 | Sur | |

FOREIGN PATENT DOCUMENTS

| | | | | |
|---|---|---|---|---|
| CN | 203446537 | U | 2/2014 | |
| CN | 104037719 | A | 9/2014 | |
| CN | 104218540 | A | 12/2014 | |
| CN | 104303524 | A | 1/2015 | |
| CN | 104432534 | A | 3/2015 | |
| CN | 105077592 | A | 11/2015 | |
| CN | 105578908 | A | 5/2016 | |
| CN | 205992857 | U | 3/2017 | |
| CN | 106858724 | A | 6/2017 | |
| CN | 107072294 | A | 8/2017 | |
| CN | 206371515 | U | 8/2017 | |
| CN | 107205477 | A | 9/2017 | |
| CN | 109283867 | A | 1/2019 | |
| CN | 109393573 | A | 3/2019 | |
| CN | 109419042 | A | 3/2019 | |
| CN | 109963606 | A | 7/2019 | |
| CN | 110122933 | A | 8/2019 | |
| CN | 110169597 | A | 8/2019 | |
| CN | 110169598 | A | 8/2019 | |
| CN | 110279149 | A | 9/2019 | |
| CN | 110367594 | A | 10/2019 | |
| CN | 110522089 | A | 12/2019 | |
| CN | 110558629 | A | 12/2019 | |
| CN | 110680026 | A | 1/2020 | |
| CN | 209931472 | U | 1/2020 | |
| CN | 110742310 | A | 2/2020 | |
| CN | 110959917 | A | 4/2020 | |
| CN | 111011940 | A | 4/2020 | |
| CN | 111083171 | A | 4/2020 | |
| CN | 210299498 | U | 4/2020 | |
| CN | 111096491 | A | 5/2020 | |
| CN | 111109657 | A | 5/2020 | |
| CN | 210445680 | U | 5/2020 | |
| CN | 111246756 | A | 6/2020 | |
| CN | 111248504 | A | 6/2020 | |
| CN | 111820464 | A | 10/2020 | |
| CN | 111820482 | A | 10/2020 | |
| CN | 214229837 | U | 9/2021 | |
| CN | 214229838 | U | 9/2021 | |
| GB | 2542011 | A | 3/2017 | |
| JP | 2017127300 | A | 7/2017 | |
| WO | WO-2014166033 | A1 * | 10/2014 | H01M 10/44 |
| WO | 2015035623 | A1 | 3/2015 | |
| WO | 2015035689 | A1 | 3/2015 | |
| WO | 2015078085 | A1 | 6/2015 | |
| WO | 2015089711 | A1 | 6/2015 | |
| WO | 2015157928 | A1 | 10/2015 | |
| WO | 2016019550 | A1 | 2/2016 | |
| WO | 2017205692 | A1 | 11/2017 | |
| WO | 2019173923 | A1 | 9/2019 | |
| WO | 2020143697 | A1 | 7/2020 | |
| WO | 2020174629 | A1 | 9/2020 | |
| WO | 2020182068 | A1 | 9/2020 | |

OTHER PUBLICATIONS

Chinese Patent Office, Office Action in Chinese Patent Application No. 202011026852.X (May 23, 2023).

Chinese Patent Office, Office Action in Chinese Patent Application No. 202011024382.3 (Jun. 21, 2023).

Chinese Patent Office, Notification of grant of patent right for invention in Chinese Patent Application No. 202011024416.9 (Apr. 24, 2025).

Chinese Patent Office, Notification of grant of patent right for invention in Chinese Patent Application No. 202011024396.5 (May 29, 2025).

U.S. Patent and Trademark Office, Office Action in U.S. Appl. No. 18/188,354 (Jul. 11, 2025).

Chinese Patent Office, Office Action in Chinese Patent Application No. 202011024396.5 (Dec. 24, 2024).

Chinese Patent Office, Office Action in Chinese Patent Application No. 202011024416.9 (Dec. 25, 2024).

Chinese Patent Office, Office Action in Chinese Patent Application No. 202010608642.5 (Jul. 26, 2022).

Chinese Patent Office, Notification of grant of patent right for invention in Chinese Patent Application No. 202010608642.5 (Jan. 5, 2023).

Patent Cooperation Treaty, International Search Report and Written Opinion, International Application No. PCT/CN2021/080825 (Jun. 23, 2021).

European Patent Office, Search Report in European Patent Application No. 21832491.1 (May 2, 2024).

Chinese Patent Office, First Office Action in Chinese Patent Application No. 202010607836.3 (Aug. 22, 2022).

Chinese Patent Office, Second Office Action in Chinese Patent Application No. 202010607836.3 (Feb. 26, 2023).

Chinese Patent Office, Notification of grant of patent right for invention in Chinese Patent Application No. 202010607836.3 (Apr. 21, 2023).

Patent Cooperation Treaty, International Search Report and Written Opinion, International Application No. PCT/CN2021/080824 (Jun. 21, 2021).

U.S. Patent and Trademark Office, Office Action in U.S. Appl. No. 18/188,376 (Feb. 5, 2026).

Chinese Patent Office, Office Action in Chinese Patent Application No. 202011026852.X (Nov. 14, 2023).

Chinese Patent Office, Office Action in Chinese Patent Application No. 202011024478.X (Dec. 18, 2023).

European Patent Office, Search Report in European Patent Application No. 20954595.3 (Nov. 23, 2023).

European Patent Office, Search Report in European Patent Application No. 20954597.9 (Nov. 23, 2023).

European Patent Office, Search Report in European Patent Application No. 20954596.1 (Nov. 23, 2023).

Chinese Patent Office, Notice of Registration and Notification to Grant Patent Right in Chinese Patent Application No. 202011024382.3 (Dec. 3, 2023).

European Patent Office, Office Action in European Patent Application No. 20954597.9 (Dec. 6, 2023).

Patent Cooperation Treaty, International Search Report and Written Opinion, International Application No. PCT/CN2020/117849 (Jun. 23, 2021).

Patent Cooperation Treaty, International Search Report and Written Opinion, International Application No. PCT/CN2020/117848 (Jun. 23, 2021).

Patent Cooperation Treaty, International Search Report and Written Opinion, International Application No. PCT/CN2020/117847 (Jun. 23, 2021).

Chinese Patent Office, First Office Action in Chinese Patent Application No. 202011024382.3 (Sep. 29, 2022).

(56) References Cited

OTHER PUBLICATIONS

U.S. Patent and Trademark Office, Office Action in U.S. Appl. No. 18/090,155 (Jun. 22, 2026).

* cited by examiner

BATTERY ROD, VAPORIZER, AND ELECTRONIC VAPORIZATION DEVICE

CROSS-REFERENCE TO PRIOR APPLICATION

This application is a continuation of International Patent Application No. PCT/CN2020/117847, filed on Sep. 25, 2020. The entire disclosure is hereby incorporated by reference herein.

FIELD

This application relates to the field of vaporization technologies, and in particular, to a battery rod, a vaporizer, and an electronic vaporization device.

BACKGROUND

In some existing electronic vaporization devices with an encryption function, a circuit board is arranged in a vaporizer of the electronic vaporization devices, and a controller MCU, a capacitor, and a switch MOS transistor are arranged on the circuit board to realize the encryption function, where the capacitor is configured to supply power to the controller, and the controller realizes communication with the battery rod by controlling turn-on and turn-off of the MOS transistor, that is, the controller feeds back data 1 and data 0 to the battery rod.

In an actual application process, the existing electronic vaporization devices generally require a high-power MOS transistor and/or a large-capacity capacitor to operate normally, but the high-power MOS transistor and the large-capacity capacitor are generally large in size. As a result, an area of the circuit board may be significantly increased, which limits the application of the encryption function to small-scale cartridges.

SUMMARY

In an embodiment, the present invention provides a battery rod, comprising: a first connecting end and a second connecting end configured to be connected with a vaporizer inserted into the battery rod; and a control chip connected with the first connecting end and configured to send a first communication signal to the vaporizer inserted into the battery rod and to receive a second communication signal from the vaporizer through the first connecting end so as to realize communication between the battery rod and the vaporizer, wherein the first communication signal comprises a first level signal as a logic high level and a second level signal as a logic low level, wherein the second communication signal comprises a third level signal as a logic high level and a fourth level signal as a logic low level, and wherein a voltage difference between the first level signal and the second level signal is greater than a voltage difference between the third level signal and the fourth level signal.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
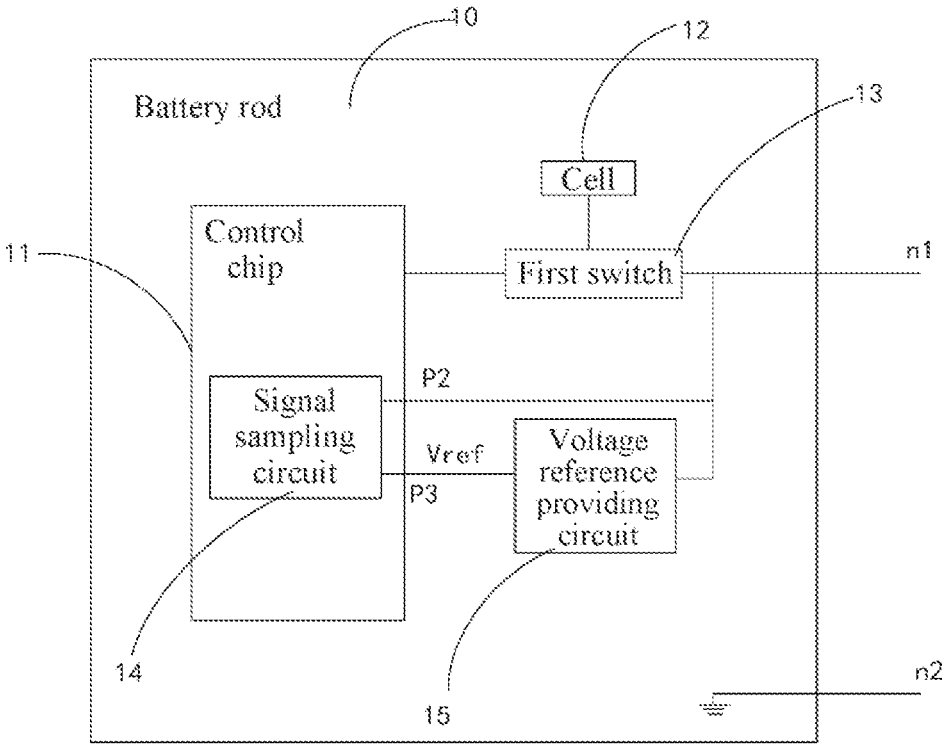
FIG. 1 is a schematic diagram of functional modules of a first embodiment of a battery rod according to this application.

In an embodiment, the present invention provides a battery rod, a vaporizer, and an electronic vaporization device, which can reduce the power of a control switch in the vaporizer, thereby further reducing a size of a circuit board of the vaporizer and reducing costs.

In an embodiment, the present invention provides a battery rod, including: a first connecting end and a second connecting end, configured to be connected with a vaporizer inserted into the battery rod; and a control chip, connected with the first connecting end to send a first communication signal to the vaporizer inserted into the battery rod and receive a second communication signal from the vaporizer through the first connecting end, to realize communication between the battery rod and the vaporizer, where the first communication signal includes a first level signal as a logic high level and a second level signal as a logic low level; and the second communication signal includes a third level signal as a logic high level and a fourth level signal as a logic low level, and a voltage difference between the first level signal and the second level signal is greater than a voltage difference between the third level signal and the fourth level signal.

The battery rod further includes: a cell, configured to provide a battery voltage; and a first switch, including a first path end, a second path end, and a control end, where the first path end of the first switch is connected with the cell and the second path end is connected with the first connecting end; the control chip includes a power control pin, and the power control pin is connected with the control end of the first switch to control turn-on and turn-off of the first switch; when the first switch is turned on, the battery voltage outputs the first level signal at the first connecting end through the first switch that is turned on; and when the first switch is turned off, the battery rod outputs the second level signal at the first connecting end, so as to send the first communication signal to the vaporizer through the first connecting end.

The control chip further includes: a detection pin, connected with the first connecting end to detect a voltage on the first connecting end, where the control chip recognizes and determines the second communication signal based on the voltage detected by the detection pin.

When the battery rod receives the second communication signal from the vaporizer, the first switch is turned on to cause the battery voltage to output the first level signal at the first connecting end through the first switch that is turned on; when the vaporizer operates in a first state, the voltage on the first connecting end is maintained at the first level signal, the detection pin detects the third level signal in the second communication signal, and the third level signal is equal to the first level signal; and when the vaporizer operates in a second state, the voltage on the first connecting end is reduced to the fourth level signal, the detection pin detects the fourth level signal in the second communication signal, and the fourth level signal is greater than the second level signal but less than the first level signal.

A difference between a voltage on the first connecting end when the vaporizer operates in the first state and a voltage on the first connecting end when the vaporizer operates in the second state is within a range (0, 1.2].

The battery rod further includes: a current-limiting circuit, configured to be connected with the first connection end to output the third level signal at the first connection end when receiving the second communication signal from the vaporizer; when the vaporizer operates in the first state, the voltage on the first connecting end is maintained at the third level signal, the detection pin detects the third level signal in the second communication signal, and the third level signal is greater than the second level signal but less than the first level signal; and when the vaporizer operates in the second state, the voltage on the first connecting end is reduced to the fourth level signal, the detection pin detects the fourth level signal in the second communication signal, and the fourth level signal is equal to the second level signal.

The current-limiting circuit includes: a second switch, including a first path end, a second path end, and a control end, where the first path end of the second switch is connected with the cell to receive the battery voltage; and a current-limiting resistor, arranged between the second path end of the second switch and the first connecting end, where the control chip further includes a current-limiting control pin, the current-limiting control pin is connected with the control end of the second switch to control turn-on of the second switch, and when the battery rod receives the second communication signal from the vaporizer, the control chip controls the second switch to be turned on through the current-limiting control pin to output the third level signal at the first connecting end.

The control chip further includes: a signal sampling circuit, connected with the detection pin and receiving a voltage reference to recognize and determine the second communication signal based on the voltage reference.

The control chip further includes a voltage reference pin configured to receive the voltage reference; and the battery rod further includes: a voltage reference providing circuit, arranged between the voltage reference pin and the first connecting end to generate the voltage reference by using the third level signal on the first connecting end, where the voltage reference is less than the third level signal but greater than the fourth level signal.

To resolve the foregoing technical problems, a second technical solution provided by this application is as follows: A vaporizer is provided, including: a first connecting end and a second connecting end, configured to be connected with a battery rod when the first connecting end and the second connecting end are inserted into the battery rod; and a processing chip, connected with the first connecting end to receive a first communication signal from the battery rod through the first connecting end, and send a second communication signal to the battery rod to realize communication between the battery rod and the vaporizer, where the first communication signal includes a first level signal as a logic high level and a second level signal as a logic low level; and the second communication signal includes a third level signal as a logic high level and a fourth level signal as a logic low level, and a voltage difference between the first level signal and the second level signal is greater than a voltage difference between the third level signal and the fourth level signal.

The vaporizer further includes: a heating element; and a control switch and a controllable resistor, where the control switch and the controllable resistor are connected in series and are connected in parallel with the heating element between the first connecting end and the second connecting end, and the control switch receives a control signal of the processing chip to be in a turn-on state or a turn-off state; when the control switch is in the turn-off state, the vaporizer operates in a first state, a voltage on the first connecting end is maintained at the third level signal, and the third level signal is equal to the first level signal; and when the control switch is in the turn-on state, the vaporizer operates in a second state, the voltage on the first connecting end is reduced to the fourth level signal, and the fourth level signal is greater than the second level signal but less than the first level signal.

To resolve the foregoing technical problems, a third technical solution provided by this application is as follows: An electronic vaporization device is provided, including: a battery rod, including the battery rod according to any one of the foregoing; and a vaporizer, including the vaporizer according to any one of the foregoing.

Beneficial effects of this application are as follows: Different from the related art, according to the battery rod, the vaporizer, and the electronic vaporization device provided in this application, when communication recognition is performed, the voltage difference between the first level signal and the second level signal that are sent to the vaporizer by the battery rod is greater than the voltage difference between the third level signal and the fourth level signal that are fed back by the vaporizer to the battery rod, so as to reduce the power of the control switch in the vaporizer, thereby further reducing the size of the circuit board of the vaporizer and reducing the costs.

The following clearly and completely describes the technical solutions in embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts shall fall within the protection scope of this application.

FIG. 1 is a schematic diagram of functional modules of a first embodiment of a battery rod according to this application. Specifically, the battery rod 10 includes a first connecting end n1 and a second connecting end n2 configured to be connected with a vaporizer inserted into the battery rod 10.

The battery rod 10 further includes a control chip 11 connected with the first connecting end n1, to send a first communication signal to the vaporizer inserted into the battery rod 10 and receive a second communication signal from the vaporizer through the first connecting end n1, so as to realize communication between the battery rod 10 and the vaporizer, where the second connecting end n2 is grounded. In an embodiment, the control chip 11 includes a power supply control pin P1.

Figure 5:
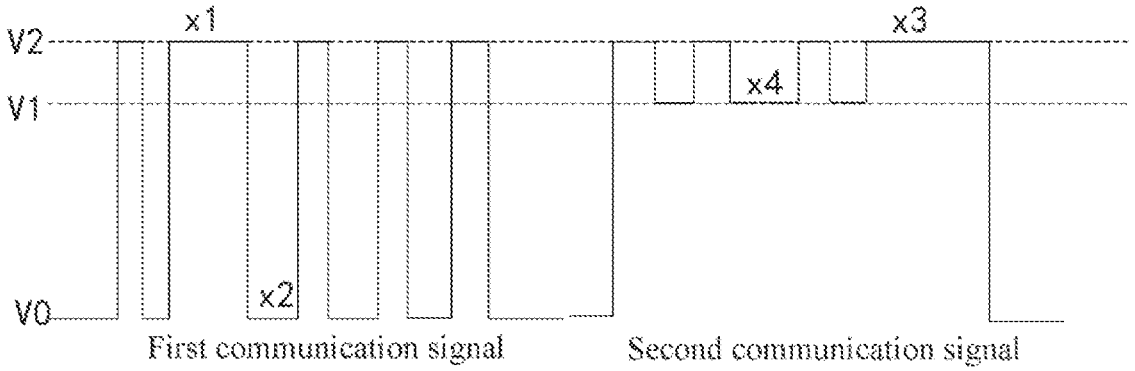
FIG. 5 is a time sequence oscillogram when the electronic vaporization device shown in FIG. 4 performs communication recognition.

Specifically, referring to FIG. 5, the first communication signal includes a first level signal x1 as a logic high level and a second level signal x2 as a logic low level; and the second communication signal includes a third level signal x3 as a logic high level and a fourth level signal x4 as a logic low level. Specifically, in an embodiment, a voltage value of the first level signal x1 is V2, a voltage value of the second level signal x2 is V0, a voltage value of the third level signal x3 is V2, and a voltage value of the fourth level signal x4 is V1. A voltage difference (V2−V0) between the voltage value V2 of the first level signal x1 and the voltage value V0 of the second level signal x2 is greater than a voltage difference (V2−V1) between the voltage value V2 of the third level signal x3 and the voltage value V1 of the fourth level signal x4.

Optionally, the battery rod 10 further includes a cell 12 and a first switch 13, and the cell 12 is configured to provide a battery voltage Vbat. When the first switch 13 is turned on, the battery voltage Vbat outputs the first level signal x1 at the first connection end n1 through the first switch 13 that is turned on; and when the first switch 13 is turned off, the battery rod 10 outputs the second level signal x2 at the first connecting end n1 to send the first communication signal to the vaporizer through the first connecting end n1. Specifically, data "1" is sent when the first level signal x1 is outputted, and data "0" is sent when the second level signal x2 is outputted.

Figure 2:
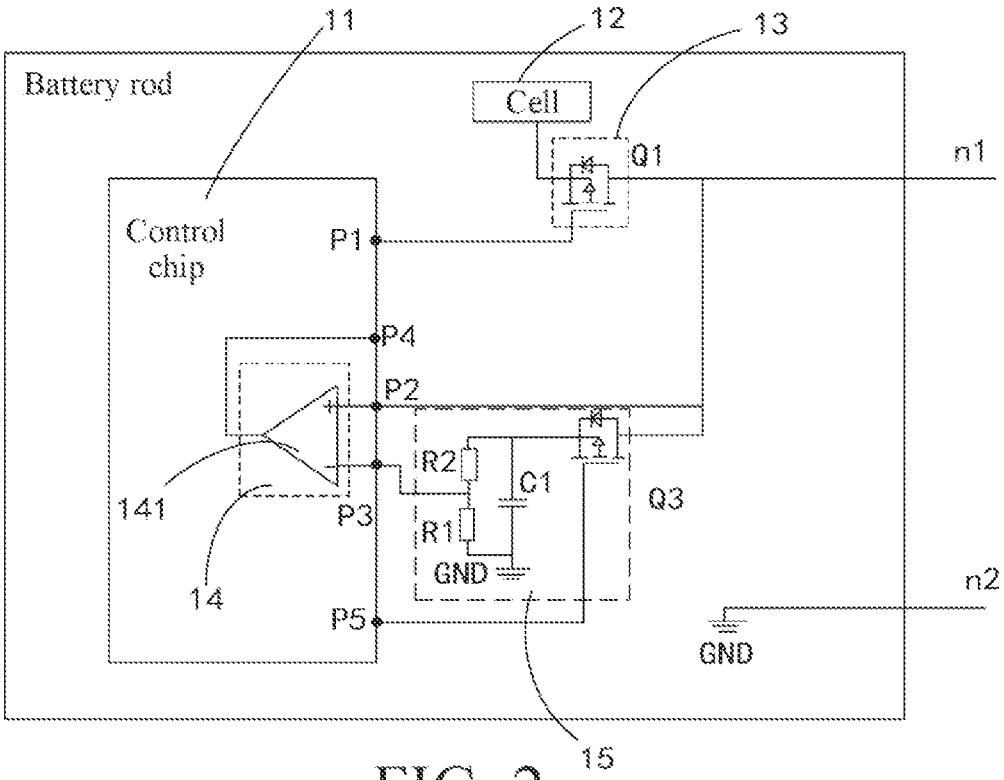
FIG. 2 is a schematic structural diagram of a specific embodiment of the battery rod shown in FIG. 1.

Specifically, as shown in FIG. 2, the first switch 13 includes a first switch Q1, and the first switch Q1 includes a first path end, a second path end, and a control end, where the first path end of the first switch Q1 is connected with the cell 12, the second path end is connected with the first connecting end n1, and the control end of the first switch Q1 is connected with the power supply control pin P1. Specifically, the power supply control pin P1 is configured to control turn-on or turn-off of the first switch Q1.

Optionally, the control chip 11 further includes: a detection pin P2 and a voltage reference pin P3. The detection pin P2 is connected with the first connection end n1 to detect a voltage on the first connection end n1. Specifically, the control chip 11 recognizes and determines the second communication signal based on the voltage detected by the detection pin P2, and then determines that data received by the battery rod 10 is "1" or "0". Specifically, the control chip 11 further includes: a signal sampling circuit 14, connected with the detection pin P2 to detect and obtain a voltage fed back by the vaporizer to the first connection end n1 through the detection pin P2, and also connected with the voltage reference pin P3 to receive a voltage reference Vref, so as to recognize and determine that the voltage fed back by the vaporizer to the first connection end n1 is the third level signal x3 or the fourth level signal x4 according to the voltage reference Vref.

The battery rod 10 further includes: a voltage reference providing circuit 15, arranged between the voltage reference pin P3 and the first connection end n1. That is, the voltage reference providing circuit 15 is connected between the voltage reference pin P3 and the first connection end n1 to generate the voltage reference Vref by using the third level signal x3 on the first connection end n1, where the voltage reference Vref is less than the voltage value V2 of the third level signal x3 or the first level signal x1 but is greater than the voltage value V1 of the fourth level signal x4.

Referring to FIG. 2, the signal sampling circuit 14 includes a comparator 141. Specifically, the comparator 141 includes a first input end, a second input end, and an output end. The first input end is connected with the detection pin P2 to detect the voltage fed back by the vaporizer to the first connection end n1; the second input end is connected with the voltage reference pin P3 to receive the voltage reference Vref; and the output end is connected with a pin P4 of the control chip to output a result corresponding to the recognized and determined second communication signal. In an alternative embodiment, the comparator 141 may also be an amplification circuit built by an analog-to-digital converter, an operational amplifier, a triode, a MOS transistor, or the like. In a specific embodiment, the signal sampling circuit 14 may also be arranged outside the control chip 11. After recognizing and determining that the voltage fed back by the vaporizer to the first connection end n1 is the third level signal x3 or the fourth level signal x4, a feedback result is transmitted to the control chip 11 for further processing by the control chip 11.

The voltage reference providing circuit 15 includes: a third switch Q3, a first resistor R1, a second resistor R2, and a first capacitor C1. The third switch Q3 includes a first path end, a second path end, and a control end. The first path end of the third switch Q3 is connected with the first connecting end n1, the control end is connected with a pin P5 of the control chip 11, and the pin P5 of the control chip 11 controls turn-off and turn-on of the third switch Q3. A first end of the second resistor R2 is connected with the second path end of the third switch Q3. A first end of the first resistor R1 is connected with a second end of the second resistor R2, and a second end of the first resistor R1 is grounded. A first end of the first capacitor C1 is connected with the first end of the second resistor R2, and a second end of the first capacitor C1 is grounded.

In an embodiment, when the vaporizer operates in a first state, the voltage on the first connecting end n1 is maintained at the first level signal x1, the detection pin P2 detects the third level signal x3 in the second communication signal, that is, the battery rod 10 obtains the data "1", and the voltage value of the third level signal x3 is equal to the voltage value of the first level signal x1, that is, the voltage value V2. When the vaporizer operates in a second state, the voltage on the first connecting end n1 is reduced from the first level signal x1 to the fourth level signal x4, the detection pin P2 detects the fourth level signal x4 in the second communication signal, that is, the battery rod 10 obtains the data "0", and the voltage value V1 of the fourth level signal x4 is greater than the voltage value V0 of the second level signal x2 but less than the voltage value V2 of the first level signal x1.

Figure 3:
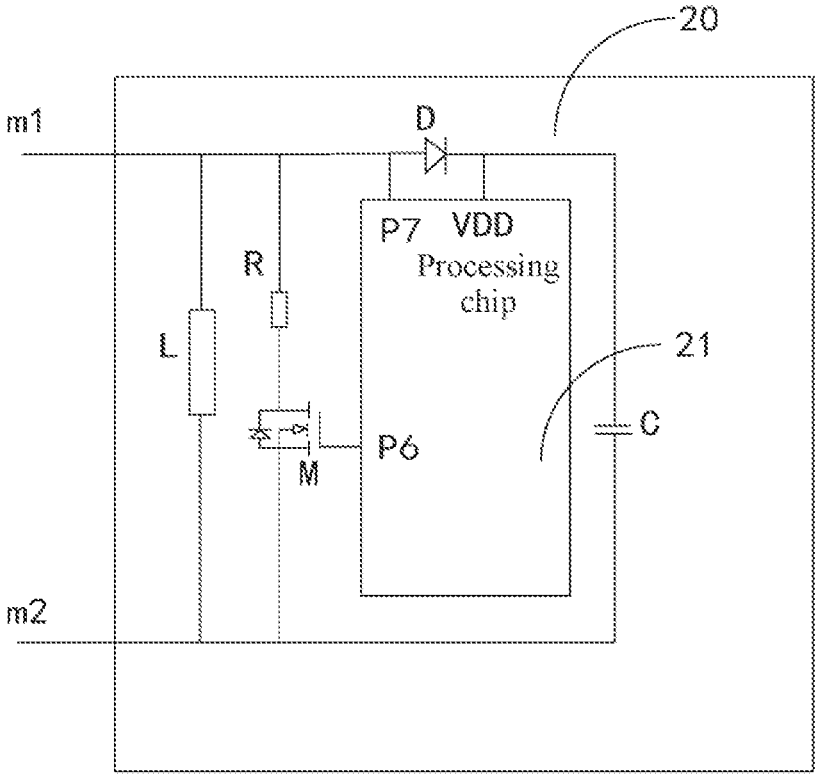
FIG. 3 is a schematic structural diagram of a first embodiment of a vaporizer according to this application.

FIG. 3 is a schematic structural diagram of a first embodiment of a vaporizer according to this application. Specifically, the vaporizer 20 includes: a first connecting end m1 and a second connecting end m2, configured to be connected with a first connecting end n1 and a second connecting end n2 of a battery rod 10 when the vaporizer 20 is inserted into the battery rod 10.

The vaporizer 20 includes a processing chip 21 connected with the first connecting end m1, to receive a first communication signal from the battery rod 10 and send a second communication signal to the battery rod 10 through the first connecting end m1, thereby realizing communication between the battery rod 10 and the vaporizer 20.

Specifically, referring to FIG. 5, the first communication signal includes a first level signal x1 as a logic high level and a second level signal x2 as a logic low level; and the second communication signal includes a third level signal x3 as a logic high level and a fourth level signal x4 as a logic low level. Specifically, in an embodiment, a voltage value of the first level signal x1 is V2, a voltage value of the second level signal x2 is V0, a voltage value of the third level signal x3 is V2, and a voltage value of the fourth level signal x4 is V1. A voltage difference (V2−V0) between the voltage value V2 of the first level signal x1 and the voltage value V0 of the second level signal x2 is greater than a voltage difference (V2−V1) between the voltage value V2 of the third level signal x3 and the voltage value V1 of the fourth level signal x4.

In an embodiment, the vaporizer 20 further includes: a heating element L, a control switch M, and a controllable resistor R. The control switch M and the controllable resistor R are connected in series, and are connected in parallel with the heating element L between the first connecting end m1 and the second connecting end m2. The control switch M receives a control signal of the processing chip 21 to be in a turn-on state or a turn-off state. When the control switch M is in the turn-off state, the vaporizer 20 operates in a first state, a voltage on the first connecting end m1 is maintained at the third level signal x3, and the voltage value of the third level signal x3 is equal to the voltage value of the first level signal x1, that is, the voltage value V2. When the control switch M is in the turn-on state, the vaporizer 20 operates in a second state, the voltage on the first connecting end m1 is reduced from the voltage value V2 corresponding to the first level signal x1 to the voltage value V1 corresponding to the fourth level signal x4, and the voltage value V1 of the fourth level signal x4 is greater than the voltage value V0 of the second level signal x2 but less than the voltage value V2 of the first level signal x1, as shown in FIG. 5.

Specifically, the control switch M includes a first path end, a second path end, and a control end. The control end of the control switch M is connected with a pin P6 of the processing chip 21, and is configured to receive a driving signal to be in the turn-on state or the turn-off state according to the driving signal. A second end of the controllable resistor R is connected with the first path end of the control switch M, a first end of the controllable resistor R is connected with a first end of the heating element L, and a second end of the heating element L is connected with the second path end of the control switch M and the second connecting end m2.

Optionally, in an embodiment, the vaporizer 20 further includes a diode D, where a cathode of the diode D is connected with a voltage pin VDD of the processing chip 21, and an anode of the diode D is connected with a pin P7 of the processing chip 21. In an embodiment, the diode D may also be a MOSFET, a triode, or the like. Optionally, the vaporizer 20 further includes a capacitor C, where a first end of the capacitor C is connected with the cathode of the diode D, and a second end of the capacitor C is connected with the second connecting end m2.

In an embodiment, the voltage value V2 of the first level signal x1 ranges from VDD to Vbat, where VDD is a minimum operating voltage of the processing chip 21 and Vbat is a battery voltage. Specifically, the voltage value V1 of the fourth level signal x4 ranges from VDD to Vbat, the voltage value V0 of the second level signal x2 ranges from 0 to 0.3*VDD, and the voltage value V2 of the first level signal x1 is greater than the voltage value V1 of the fourth level signal x4 and is further greater than the voltage value V0 of the second level signal x2, where VDD (a voltage at which the processing chip 21 may operate normally) is less than or equal to Vbat (the battery voltage).

During a process that the vaporizer 20 feeds back data, the voltage value V1 of the fourth level signal x4 is always greater than the minimum operating voltage VDD of the processing chip 21 and may supply power to the processing chip 21. Therefore, the capacitor C of the processing chip 21 may be reduced or even canceled to reduce a size and costs of a circuit board of the vaporizer 20. Further, the control switch M, the controllable resistor R, the diode D, and the capacitor C may be integrated into the processing chip 21 to further reduce the costs.

When the control switch M is in the turn-off state, the vaporizer 20 operates in the first state, the voltage on the first connecting end m1 is maintained at the third level signal x3, and the third level signal x3 is equal to the first level signal x1. When the control switch M is in the turn-on state, the vaporizer 20 operates in the second state, the voltage on the first connecting end m1 is reduced to the fourth level signal x4, and the voltage value V1 of the fourth level signal x4 is greater than the voltage value V0 of the second level signal x2 but less than the voltage value V2 of the first level signal x1.

Figure 4:
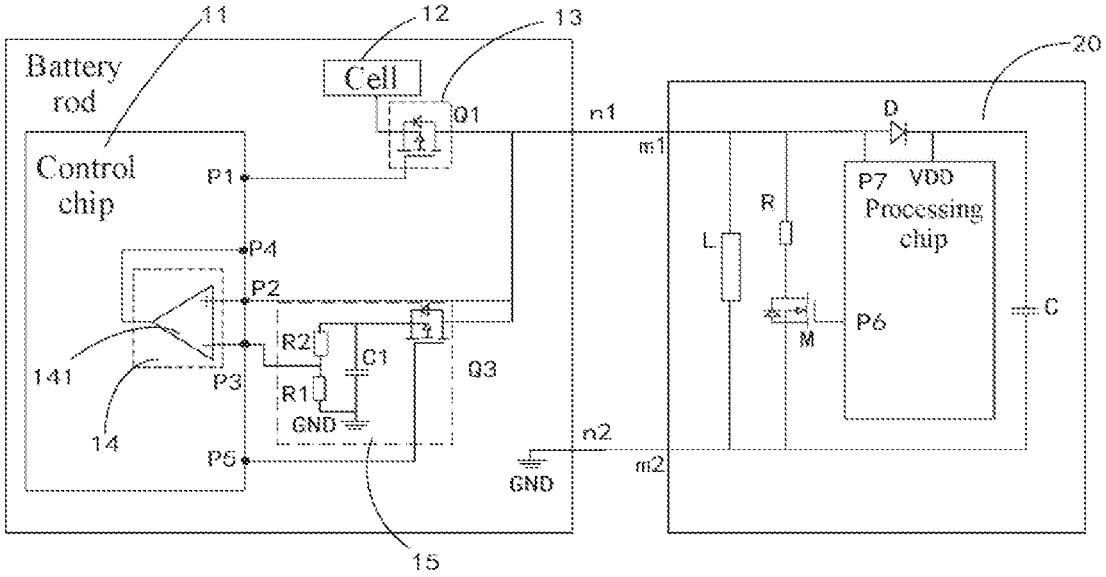
FIG. 4 is a schematic structural diagram of an embodiment of an electronic vaporization device formed by inserting the vaporizer shown in FIG. 3 into the battery rod shown in FIG. 2.

FIG. 4 is a schematic structural diagram of an embodiment of an electronic vaporization device formed by inserting the vaporizer shown in FIG. 3 into the battery rod shown in FIG. 2. The vaporizer 20 is inserted into the battery rod 10 to form the electronic vaporization device. Specifically, when the vaporizer 20 is inserted into the battery rod 10, the first connecting end m1 of the vaporizer 20 is connected with the first connecting end n1 of the battery rod 10, and the second connecting end m2 of the vaporizer 20 is connected with the second connecting end n2 of the battery rod 10. In another embodiment, when the vaporizer 20 is inserted into the battery rod 10, the first connecting end m1 of the vaporizer 20 may also be connected with the second connecting end n2 of the battery rod 10, and the second connecting end m2 of the vaporizer 20 may be connected with the first connecting end n1 of the battery rod 10. This embodiment is illustrated in detail by using an example in which the first connecting end m1 of the vaporizer 20 is connected with the first connecting end n1 of the battery rod 10, and the second connecting end m2 of the vaporizer 20 is connected with the second connecting end n2 of the battery rod 10.

Specifically, referring to FIG. 5, FIG. 5 is a time sequence oscillogram when the battery rod and the vaporizer in the electronic vaporization device shown in FIG. 4 communicate with each other. When the vaporizer 20 is inserted into the battery rod 10, the battery rod 10 sends the first communication signal to the vaporizer 20. Specifically, the power supply control pin P1 of the battery rod 10 controls the first switch Q1 to be turned on, and the cell 12 outputs the first level signal x1 (that is, sending the data "1") at the first connecting end n1 through the first switch Q1 that is turned on; or the power supply control pin P1 of the battery rod 10 controls the first switch Q1 to be turned off, and the cell 12 outputs the second level signal x2 (that is, sending the data "0") at the first connecting end n1 through the first switch Q1 that is turned off.

Specifically, after receiving the first communication signal, the vaporizer 20 sends the second communication signal to the battery rod 10. Specifically, the third level signal x3 or the fourth level signal x4 is provided for the battery rod 10 by turn-on or turn-off of the controllable resistor R.

In a specific embodiment, the vaporizer 20 operates in the first state when the processing chip 21 controls the controllable switch M to be in the turn-off state. When the vaporizer 20 operates in the first state, the voltage on the first connecting end m1 is maintained at the first level signal x1. Because the voltage value of the third level signal x3 is equal to the voltage value of the first level signal x1, that is, the voltage value V2, the detection pin P2 detects the third level signal x3 in the second communication signal, so that the battery rod 10 obtains the data "1" fed back by the vaporizer 20.

The vaporizer 20 operates in the second state when the processing chip 21 controls the controllable switch M to be in the turn-on state. When the vaporizer 20 operates in the second state, the voltage on the first connecting end m1 is reduced to the fourth level signal x4, and the voltage value V1 of the fourth level signal x4 is greater than the voltage value V0 of the second level signal x2 but less than the voltage value V2 of the first level signal x1, so that the battery rod 10 obtains the data "0" fed back by the vaporizer 20. Specifically, when the controllable switch M is in the turn-on state, an internal resistance of the cell 12, an internal resistance of the first switch Q1, and the controllable resistor R form a voltage divider, and the first level signal x1 on the first connecting end m1 is then reduced to the fourth level signal x4, so that the battery rod 10 obtains the data "0".

Specifically, when the detection pin P2 of the control chip 11 detects the third level signal x3 or the fourth level signal x4, the comparator 141 is used to compare the third level signal x3 or the fourth level signal x4 with the voltage reference Vref, so as to determine that the received data is "1" or "0". In a specific embodiment, a voltage value of the voltage reference Vref is greater than the voltage value V1 of the fourth level signal x4 but less than the voltage value V2 of the first level signal x1 or the third level signal x3. Thus, when the voltage obtained through sampling by the detection pin P2 is greater than the voltage reference Vref, it may be determined that the detection pin P2 detects the third level signal x3, that is, the battery rod 10 receives the data "1"; and when the voltage obtained through sampling by the detection pin P2 is less than the voltage reference Vref, it may be determined that the detection pin P2 detects the fourth level signal x4, that is, the battery rod 10 receives the data "0".

Specifically, in an embodiment, the voltage of the voltage reference Vref may be obtained directly from the first level signal x1 applied to the heating element L. After the first capacitor C1 is fully charged, the third switch Q3 is turned off, and the voltage reference Vref may remain stable for a period of time. In other embodiments, the voltage of the voltage reference Vref may also be obtained from a digital-to-analog converter of the control chip 11, or may be obtained from the battery voltage Vbat, which is not specifically limited herein.

In an embodiment, a difference between the voltage (Vbat*Rh/(Re+Rh)) on the first connecting end n1 when the vaporizer 20 operates in the first state and the voltage (Vbat*Rp/(Re+Rp)) on the first connecting end n1 when the vaporizer operates in the second state is within a range (0, 1.2]. That is:

$$0 < \frac{Vbat * Rh}{Re + Rh} - \frac{Vbat * Rp}{Re + Rp} \leq 1.2;$$

Vbat is the battery voltage, Re is a sum of the internal resistance of the battery 12 and an internal resistance of the first switch Q1 that is turned on, Rh is a resistance of the heating element L, and Rp is a resistance of the controllable resistor R and the heating element L that are connected in parallel. In an embodiment, a resistance range of the controllable resistor R may be determined through the foregoing formula.

In the electronic vaporization device including the vaporizer and the battery rod of this embodiment, the controllable resistor R is arranged in the vaporizer 20. When the controllable switch M is turned on, the controllable resistor R can form a voltage divider with the internal resistance of the cell 12 and the internal resistance of the first switch Q1 that is turned on, to reduce the voltage on the first connection end n1 from the first level signal x1 to the fourth level signal x4. Therefore, the voltage difference (V2–V0) between the first level signal x1 and the second level signal x2 is greater than the voltage difference (V2–V1) between the third level signal x3 and the fourth level signal x4, and a current flowing through the control switch M is further reduced. In this way, the power of the control switch M may be reduced, thereby reducing the size of the control switch M and reducing the size and the costs of the circuit board of the vaporizer.

Figure 6:
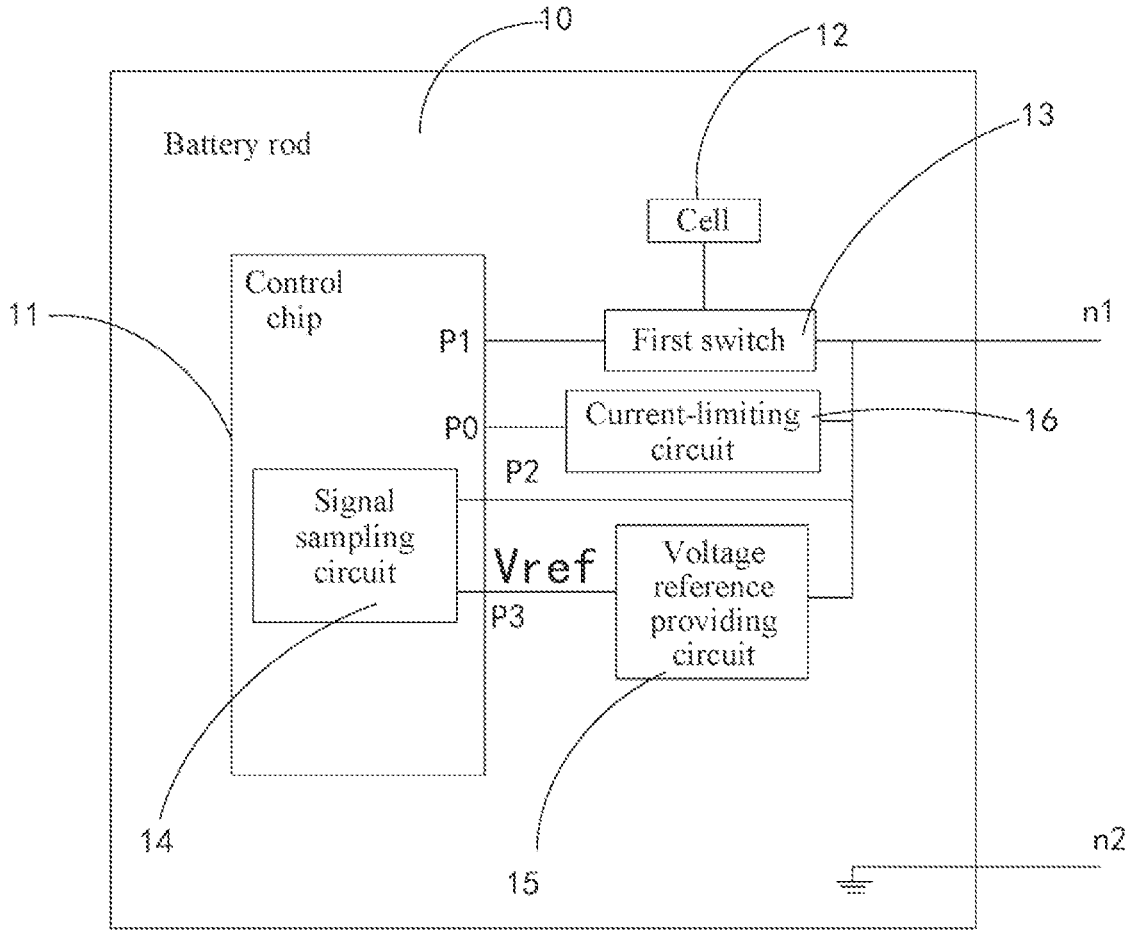
FIG. 6 is a schematic diagram of functional modules of a second embodiment of a battery rod according to this application.

FIG. 6 is a schematic diagram of functional modules of a second embodiment of a battery rod according to this application. Compared with the foregoing first embodiment shown in FIG. 1, a difference lies in that this embodiment further includes a current-limiting circuit 16 connected with the first connection end n1 to output a third level signal at the first connection end n1 when receiving the second communication signal from the vaporizer 20.

Figure 7:
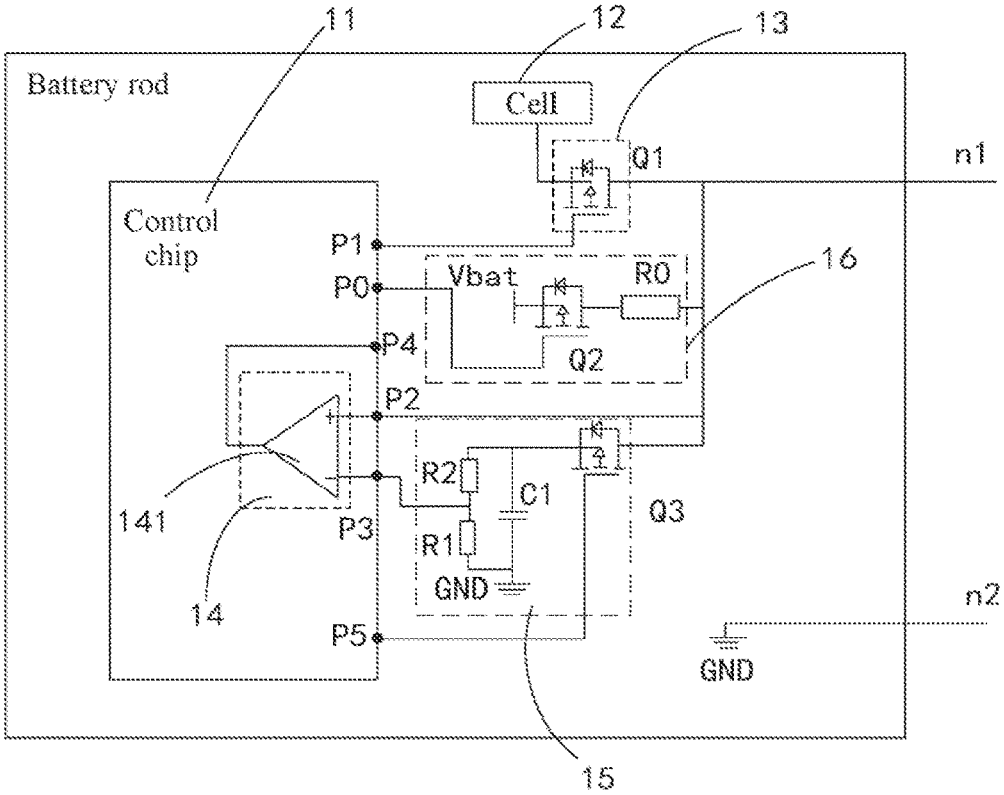
FIG. 7 is a schematic structural diagram of a specific embodiment of the battery rod shown in FIG. 6.

Specifically, referring to FIG. 7, the current-limiting circuit 16 includes: a second switch Q2 and a current-limiting resistor R0. The second switch Q2 includes a first path end, a second path end, and a control end. The first path end of the second switch Q2 is connected with the cell 12 to receive the battery voltage Vbat, and the current-limiting resistor R0 is arranged between the second path end of the second switch Q1 and the first connection end n1. Specifically, the current-limiting resistor R0 connects the second path end of the second switch Q1 with the first connecting end n1. The control chip 11 further includes a current-limiting control pin P0 connected with the control end of the second switch Q2 to control turn-on of the second switch Q2. When the battery rod 10 receives the second communication signal from the vaporizer 20, the control chip 11 controls the second switch Q2 to be turned on through the current-limiting control pin P0, so as to output the third level signal at the first connecting end n1.

Figure 10:
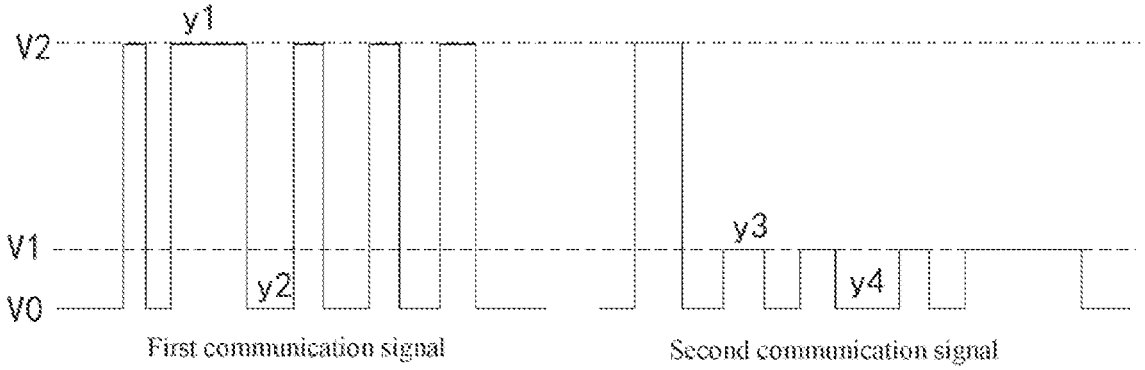
FIG. 10 is a time sequence oscillogram when the electronic vaporization device shown in FIG. 9 performs communication recognition.

Specifically, referring to FIG. 10, in this embodiment, when the vaporizer 20 operates in the first state, the voltage on the first connection end n1 is maintained at the third level signal y3, and the detection pin P2 detects the third level signal y3 in the second communication signal, thereby obtaining the data "1" fed back by the vaporizer 20. A voltage value V1 of the third level signal y3 is greater than a voltage value V0 of a second level signal y2 but less than a voltage value V2 of a first level signal y1. When the vaporizer 20 operates in the second state, the voltage on the first connecting end n1 is reduced from the voltage value V1 of the third level signal y3 to the voltage value V0 of a fourth level signal y4, and the detection pin P2 detects the fourth level signal y4 in the second communication signal, thereby obtaining the data "0" fed back by the vaporizer 20. The voltage value of the fourth level signal y4 is equal to the voltage value of the second level signal y2, which both are the voltage value V0.

Figure 8:
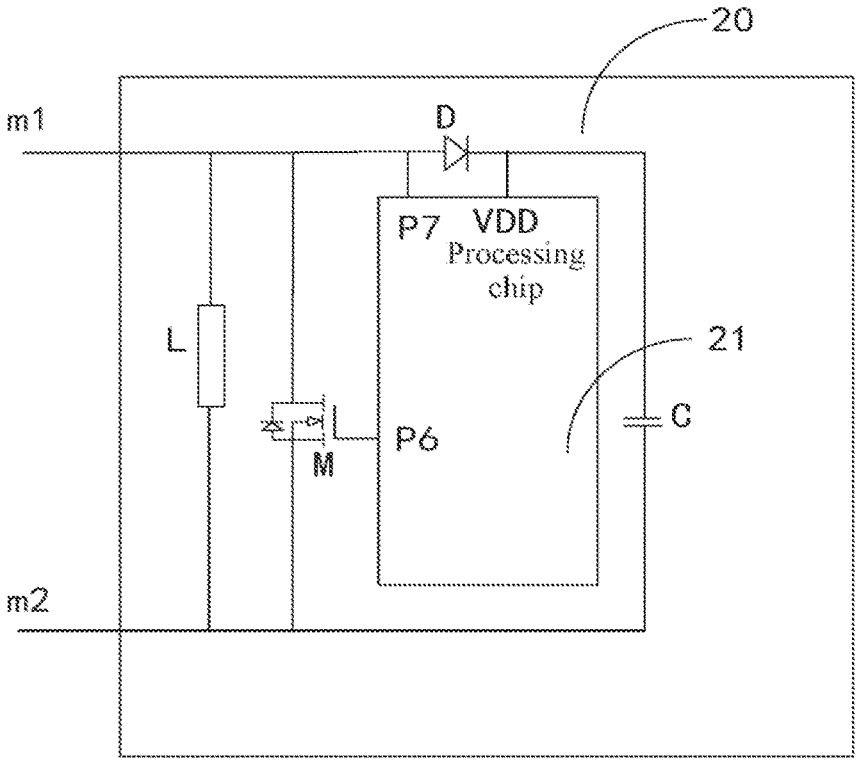
FIG. 8 is a schematic structural diagram of a second embodiment of a vaporizer according to this application.

FIG. 8 is a schematic structural diagram of a second embodiment of a vaporizer according to this application. Compared with the schematic structural diagram of the first embodiment of the vaporizer shown in FIG. 3, a difference lies in that a controllable resistor R in the vaporizer shown in this embodiment is 0, i.e. the vaporizer shown in this embodiment does not include the controllable resistor R. Specifically, the vaporizer 20 of this application includes: a first connecting end m1 and a second connecting end m2, configured to be connected with a battery rod 10 when the vaporizer 20 is inserted into a battery rod 10.

The vaporizer 20 includes a processing chip 21 connected with the first connecting end m1, to receive a first communication signal from the battery rod 10 and send a second communication signal to the battery rod 10 through the first connecting end m1, thereby realizing communication between the battery rod 10 and the vaporizer 20.

The first communication signal includes a first level signal y1 as a logic high level and a second level signal y2 as a logic low level; and the second communication signal includes a third level signal y3 as a logic high level and a fourth level signal y4 as a logic low level. Specifically, in this embodiment, a voltage value of the first level signal y1 is V2, a voltage value of the second level signal y2 is V0, a voltage value of the third level signal y3 is V1, and a voltage value of the fourth level signal y4 is V0, where a voltage difference (V2−V0) between the voltage value V2 of the first level signal y1 and the voltage value V0 of the second level signal y2 is greater than a voltage difference (V1−V0) between the voltage value V1 of the third level signal y3 and the voltage value V0 of the fourth level signal y4.

In an embodiment, the vaporizer 20 further includes: a heating element L and a control switch M. The control switch M and the heating element L are connected in parallel between the first connecting end m1 and the second connecting end m2, and the control switch M receives a control signal of the processing chip 21 to be in a turn-on state or a turn-off state. When the control switch M is in the turn-off state, a voltage on the first connecting end m1 is maintained at the third level signal y3, so that the battery rod 10 obtains data "1" fed back by the vaporizer 20. When the control switch M is in the turn-on state, the voltage on the first connecting end m1 is reduced to the fourth level signal y4, so that the battery rod 10 obtains data "0" fed back by the vaporizer 20.

Specifically, the control switch M includes a first path end, a second path end, and a control end. The control end of the control switch M is connected with a pin P6 of the processing chip 21 and is configured to receive a driving signal to be in the turn-on state or the turn-off state according to the driving signal. A second end of the heating element L is connected with the second path end of the control switch M and the second connecting end m2, and a first end of the heating element L is connected with the first path end of the control switch M and the first connecting end m1.

Optionally, in an embodiment, the vaporizer 20 further includes a diode D, where a cathode of the diode D is connected with a voltage pin VDD of the processing chip 21, and an anode of the diode D is connected with a pin P7 of the processing chip 21. In an embodiment, the diode D may also be a MOSFET, a triode, or the like. Optionally, the vaporizer 20 further includes a capacitor C, where a first end of the capacitor C is connected with the cathode of the diode D, and a second end of the capacitor C is connected with the second connecting end m2.

In an embodiment, the voltage value V2 of the first level signal y1 ranges from VDD to Vbat, where VDD is a minimum operating voltage of the processing chip 21 and Vbat is a battery voltage. Specifically, the voltage value V1 of the third level signal y3 ranges from 0 to Vbat, the voltage value V0 of the second level signal y2 ranges from 0 to 0.3*VDD, and the voltage value V2 of the first level signal y1 is greater than the voltage value V1 of the third level signal y3 and is further greater than the voltage value V0 of the second level signal y2, where VDD (a voltage at which the processing chip 21 may operate normally) is less than or equal to Vbat (the battery voltage).

Further, the control switch M, the controllable resistor R, the diode D, and the capacitor C may be integrated into the processing chip 21 to further reduce the costs.

Figure 9:
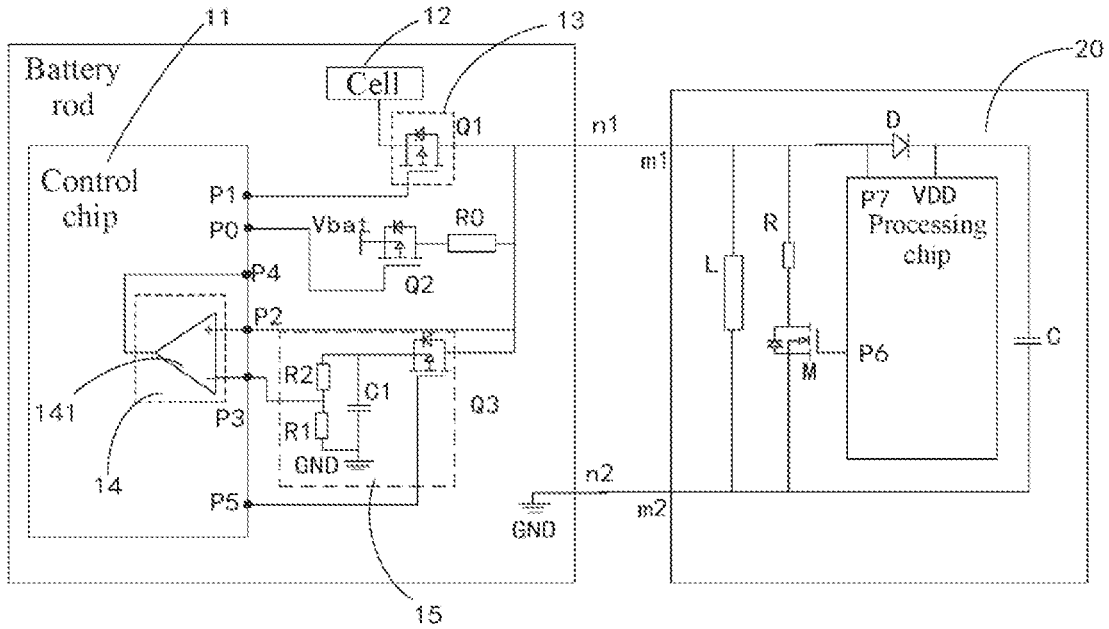
FIG. 9 is a schematic structural diagram of an embodiment of an electronic vaporization device formed by inserting the vaporizer shown in FIG. 8 into the battery rod shown in FIG. 7.

FIG. 9 is a schematic structural diagram of an embodiment of an electronic vaporization device formed by inserting the vaporizer shown in FIG. 8 into the battery rod shown in FIG. 7. Specifically, when the vaporizer 20 is inserted into the battery rod 10, the first connecting end m1 of the vaporizer 20 is connected with the first connecting end n1 of the battery rod 10, and the second connecting end m2 of the vaporizer 20 is connected with the second connecting end n2 of the battery rod 10. In another embodiment, when the vaporizer 20 is inserted into the battery rod 10, the first connecting end m1 of the vaporizer 20 may also be connected with the second connecting end n2 of the battery rod 10, and the second connecting end m2 of the vaporizer 20 may be connected with the first connecting end n1 of the battery rod 10. This embodiment is illustrated in detail by using an example in which the first connecting end m1 of the vaporizer 20 is connected with the first connecting end n1 of the battery rod 10, and the second connecting end m2 of the vaporizer 20 is connected with the second connecting end n2 of the battery rod 10.

Specifically, referring to FIG. 10, FIG. 10 is a time sequence oscillogram when the battery rod and the vaporizer in the electronic vaporization device shown in FIG. 9 communicate with each other. When the vaporizer 20 is inserted into the battery rod 10, the battery rod 10 sends the first communication signal to the vaporizer 20. Specifically, the power supply control pin P1 of the battery rod 10 controls the first switch Q1 to be turned on, and the cell 12 outputs the first level signal y1 (that is, sending the data "1") at the first connecting end n1 through the first switch Q1 that is turned on; or the power supply control pin P1 of the battery rod 10 controls the first switch Q1 to be turned off, and the battery 12 outputs the second level signal y2 (that is, sending the data "0") at the first connecting end n1 through the first switch Q1 that is turned off.

Specifically, after the vaporizer 20 receives the first communication signal, the battery rod 10 controls the second switch Q2 to be turned on through the current-limiting pin P0, and due to the existence of the current-limiting resistor R0 in the current-limiting circuit 16, the voltage value V2 of the first level signal y1 on the first connection end n1 is reduced to the voltage value V1 of the third level signal y3. When the processing chip 21 of the vaporizer 20 controls the control switch M to be in the turn-off state, the voltage on the first connecting end m1 is maintained at the voltage value V1 corresponding to the third level signal y3, so that the battery rod 10 obtains the data "1" fed back by vaporizer 20. The voltage value V1 of the third level signal y3 is greater than the voltage value V0 of the second level signal y2 but less than the voltage value V2 of the first level signal y1. When the processing chip 21 of the vaporizer 20 controls the control switch M to be in the turn-on state, the voltage on the first connecting end m1 is reduced to the voltage value V0 corresponding to the fourth level signal y4, so that the battery rod 10 obtains the data "0" fed back by the vaporizer 20. The voltage value of the fourth level signal y4 is equal to the voltage value of the second level signal y2, that is, the voltage value V0.

Specifically, in an embodiment, a voltage of a voltage reference Vref may be obtained directly from the first level signal y1 applied to the heating element L. After the first capacitor C1 is fully charged, the third switch Q3 is turned off, and the voltage reference Vref may remain stable for a period of time. In other embodiments, the voltage of the voltage reference Vref may also be obtained from a digital-to-analog converter of the control chip 11, or may be obtained from a battery voltage Vbat, which is not specifically limited herein.

In a specific embodiment, the voltage value of the voltage reference Vref is greater than the voltage value V0 of the fourth level signal y4 but less than the voltage value V1 of the third level signal y3. Thus, when a voltage obtained through sampling by the detection pin P2 is greater than the voltage reference Vref, it may be determined that the detection pin P2 detects the third level signal y3, that is, the battery rod 10 receives the data "1"; and when the voltage obtained through sampling by the detection pin P2 is less than the voltage reference Vref, it may be determined that the detection pin P2 detects the fourth level signal y4, that is, the battery rod 10 receives the data "0".

In the electronic vaporization device including the vaporizer and the battery rod in this embodiment, the voltage value V2 of the first level signal y1 may be reduced to the voltage value V1 of the third level signal y3 due to the introduction of the current-limiting resistor R0 into the battery rod 10. In this way, the voltage value of the third level signal y3 obtained by the vaporizer is low enough, so that the voltage difference (V2−V0) between the first level signal y1 and the second level signal y2 is greater than the voltage difference (V1−V0) between the third level signal y3 and the fourth level signal y4. In this case, a current flowing through the control switch M is reduced accordingly. Therefore, a low-power control switch M may be used to reduce the size and the costs of the circuit board of the vaporizer.

Only a part of the structure of the electronic vaporization device of this application is described herein, and the remaining of the structure may be the same as that of an existing electronic vaporization device, which is not described herein again.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A battery rod, comprising:
   - a first connecting end and a second connecting end configured to be connected with a vaporizer inserted into the battery rod; and
   - a control chip connected with the first connecting end and configured to send a first communication signal to the vaporizer inserted into the battery rod and to receive a second communication signal from the vaporizer through the first connecting end so as to realize communication between the battery rod and the vaporizer,
   - wherein the first communication signal comprises a first level signal as a logic high level and a second level signal as a logic low level,
   - wherein the second communication signal comprises a third level signal as a logic high level and a fourth level signal as a logic low level, and
   - wherein a voltage difference between the first level signal and the second level signal is greater than a voltage difference between the third level signal and the fourth level signal.

2. The battery rod of claim 1, further comprising:
   - a cell configured to provide a battery voltage; and
   - a first switch comprising a first path end, a second path end, and a control end, the first path end of the first switch being connected with the cell and the second path end being connected with the first connecting end,
   - wherein the control chip comprises a power supply control pin connected with the control end of the first switch so as to control turn-on and turn-off of the first switch,
   - wherein, when the first switch is turned on, the battery voltage outputs the first level signal at the first connecting end through the first switch that is turned on, and
   - wherein, when the first switch is turned off, the battery rod outputs the second level signal at the first connecting end so as to send the first communication signal to the vaporizer through the first connecting end.

3. The battery rod of claim 2, wherein the control chip further comprises:
   - a detection pin connected with the first connecting end and configured to detect a voltage on the first connecting end,
   - wherein the control chip is configured to recognize and determine the second communication signal based on the voltage detected by the detection pin.

4. The battery rod of claim 3, wherein, when the battery rod receives the second communication signal from the vaporizer, the first switch is turned on so as to cause the battery voltage to output the first level signal at the first connecting end through the first switch that is turned on,
   - wherein, when the vaporizer operates in a first state, the voltage on the first connecting end is maintained at the first level signal, the detection pin detects the third level signal in the second communication signal, and the third level signal is equal to the first level signal, and wherein, when the vaporizer operates in a second state, the voltage on the first connecting end is reduced to the fourth level signal, the detection pin detects the fourth level signal in the second communication signal, and the fourth level signal is greater than the second level signal but less than the first level signal.

5. The battery rod of claim 4, wherein a voltage difference between the first connecting end when the vaporizer operates in the first state and the first connecting end when the vaporizer operates in the second state is within a range of 0 to 1.2.

6. The battery rod of claim 3, further comprising:

a current-limiting circuit connected with the first connection end and configure to output the third level signal at the first connection end when receiving the second communication signal from the vaporizer, wherein, when the vaporizer operates in a first state, the voltage on the first connecting end is maintained at the third level signal, the detection pin detects the third level signal in the second communication signal, and the third level signal is greater than the second level signal but less than the first level signal, and wherein, when the vaporizer operates in a second state, the voltage on the first connecting end is reduced to the fourth level signal, the detection pin detects the fourth level signal in the second communication signal, and the fourth level signal is equal to the second level signal.

7. The battery rod of claim 6, wherein the current-limiting circuit comprises:

a second switch comprising a first path end, a second path end, and a control end, the first path end of the second switch being connected with the cell to receive the battery voltage; and a current-limiting resistor arranged between the second path end of the second switch and the first connecting end, wherein the control chip further comprises a current-limiting control pin connected with the control end of the second switch to control turn-on of the second switch, and wherein, when the battery rod receives the second communication signal from the vaporizer, the control chip is configured to control the second switch to be turned on through the current-limiting control pin to output the third level signal at the first connecting end.

8. The battery rod of claim 3, wherein the control chip further comprises:

a signal sampling circuit connected with the detection pin and configured to receive a voltage reference so as to recognize and determine the second communication signal based on the voltage reference.

9. The battery rod of claim 8, wherein the control chip further comprises:

a voltage reference pin configured to receive the voltage reference, and wherein the battery rod further comprises:

a voltage reference providing circuit arranged between the voltage reference pin and the first connecting end and configured to generate the voltage reference using the third level signal on the first connecting end, the voltage reference being less than the third level signal but greater than the fourth level signal.

10. A vaporizer, comprising:

a first connecting end and a second connecting end configured to be connected with a battery rod when the first connecting end and the second connecting end are inserted into the battery rod; and a processing chip connected with the first connecting end and configured to receive a first communication signal from the battery rod through the first connecting end, and to send a second communication signal to the battery rod so as to realize communication between the battery rod and the vaporizer, wherein the first communication signal comprises a first level signal as a logic high level and a second level signal as a logic low level, wherein the second communication signal comprises a third level signal as a logic high level and a fourth level signal as a logic low level, and wherein a voltage difference between the first level signal and the second level signal is greater than a voltage difference between the third level signal and the fourth level signal.

11. The vaporizer of claim 10, further comprising:

a heating element; and a control switch and a controllable resistor, the control switch and the controllable resistor being connected in series and connected in parallel with the heating element between the first connecting end and the second connecting end, the control switch being configured to receive a control signal of the processing chip to be in a turn-on state or a turn-off state, wherein, when the control switch is in the turn-off state, the vaporizer is configured to operate in a first state, a voltage on the first connecting end is maintained at the third level signal, and the third level signal is equal to the first level signal, and wherein, when the control switch is in the turn-on state, the vaporizer is configured to operate in a second state, the voltage on the first connecting end is reduced to the fourth level signal, and the fourth level signal is greater than the second level signal and less than the first level signal.

12. The vaporizer of claim 10, further comprising:

a heating element; and a control switch, wherein the control switch and the heating element are connected in parallel between the first connecting end and the second connecting end, and the control switch is configured to receive a control signal of the processing chip to be in a turn-on state or a turn-off state, wherein, when the control switch is in the turn-off state, a voltage on the first connecting end is maintained at the third level signal, and the third level signal is greater than the second level signal and less than the first level signal, and wherein, when the control switch is in the turn-on state, the voltage on the first connecting end is reduced to the fourth level signal, and the fourth level signal is equal to the second level signal.

13. An electronic vaporization device, comprising:

the battery rod of claim 1;

and the vaporizer, comprising:

a first connecting end and a second connecting end configured to be connected with the battery rod when the first connecting end of the electronic vaporization device and the second connecting end of the electronic vaporization device are inserted into the battery rod; and a processing chip connected with the first connecting end of the electronic vaporization device and configured to receive the first communication signal from the battery rod through the first connecting end of the electronic vaporization device, and to send the second communication signal to the battery rod so as to realize communication between the battery rod and the vaporizer.

* * * * *